US005139157A

United States Patent [19]

Korthaus

[11] Patent Number: 5,139,157

[45] Date of Patent: Aug. 18, 1992

[54] CONCRETE PLACING BOOM ASSEMBLY FOR READY-MIX CONCRETE

[76] Inventor: Ernst Korthaus, Gehringer Schlade 7, 5983 Balve 1, Fed. Rep. of Germany

[21] Appl. No.: 569,450

[22] Filed: Aug. 20, 1990

[30] Foreign Application Priority Data

Aug. 18, 1989 [DE] Fed. Rep. of Germany ..... 3927268

[51] Int. Cl.[5] ..... B66C 23/26; B66C 23/42; B66C 23/04

[52] U.S. Cl. ..... 212/175; 212/188; 212/230; 212/189; 212/177

[58] Field of Search ..... 212/175, 182, 187, 189, 212/204, 177, 183, 185, 176, 188, 230

[56] References Cited

U.S. PATENT DOCUMENTS 4,660,731 4/1987 Becker ..... 212/175

4,895,263 1/1990 Saint Gerand ..... 212/187

5,005,714 4/1991 Kröll et al. ..... 212/182

*Primary Examiner*—Joseph F. Peters, Jr.

*Assistant Examiner*—Kenneth Lee

*Attorney, Agent, or Firm*—Walter Ottesen

[57] ABSTRACT

The invention is directed to a concrete placing boom assembly for use with two trucks. The assembly includes a base frame and a rotatable turret rotatably mounted on the base frame. A foldable boom is pivotally connected to the turret and includes a plurality of boom arms articulately connected one with the other so as to be unfoldable to define an extended boom and foldable to define a stack. The foldable boom is separable at a separation location into two sections transportable on respective ones of the trucks. The assembly of the invention makes it unnecessary to provide auxiliary assembly apparatus for coupling the two sections together.

4 Claims, 2 Drawing Sheets

CONCRETE PLACING BOOM ASSEMBLY FOR READY-MIX CONCRETE

FIELD OF THE INVENTION

The invention relates to a concrete placing boom assembly for ready-mix concrete and includes the following: a base frame, a rotatable turret rotatably mounted on the base frame and a plurality of boom arms connected one to the other by a plurality of articulated joints.

BACKGROUND OF THE INVENTION

For concrete placing boom assemblies of the kind described above, it is necessary to provide the longest possible overall length or overhead reach in order to increase the situations in which the boom assembly can be used. At the same time, it is intended that the total transport weight of the boom assembly be held to a minimum.

Concrete placing boom assemblies which are separable are known. At least one boom component is separable and has a rapid-connect location. The other boom component is in the form of a stack and is transportable on a special vehicle. The forward boom component comprises a plurality of boom arms foldable into a stack and is mounted on the rearward boom component by means of a truck crane. The rearward boom component can comprise the base arm component.

SUMMARY OF THE INVENTION

It is an object of the invention to provide a concrete placing boom assembly which does not require a separate auxiliary arrangement such as a truck crane to assemble the boom assembly for use at the work site.

The concrete placing boom assembly of the invention includes a rotatable carrier mounted on the second vehicle which transports the boom. The concrete placing boom assembly of the invention affords the advantage of minimum weight and a separate auxiliary apparatus is not required for assembling the components of the boom assembly. The two trucks are production trucks and are completely loaded with the boom stack for the maximum reach.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
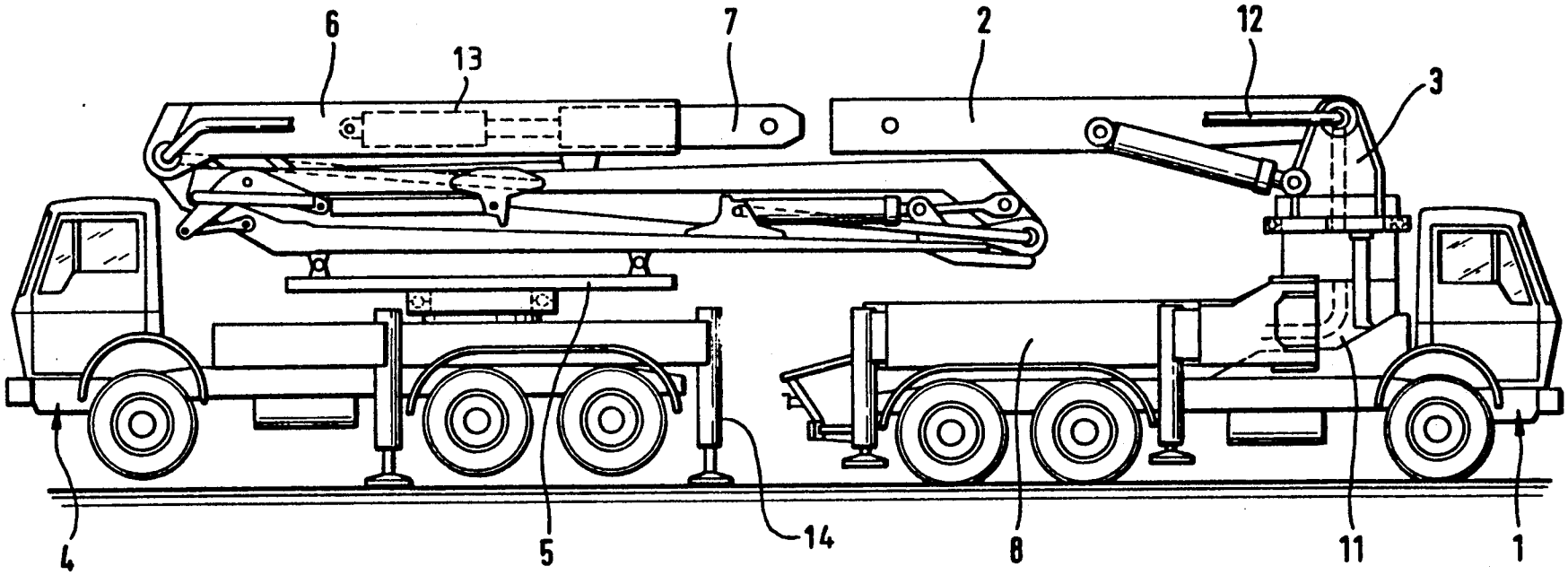
FIG. 1 shows a first embodiment of the concrete placing boom assembly according to the invention wherein a disconnect location is provided in an arm of the boom; and, FIG. 2 is another embodiment of the concrete placing boom assembly of the invention wherein the assembly is shown in the assembled condition with a disconnect location being provided between the base frame of one of the trucks and the rotatable turret.

Referring to FIG. 1, the boom arm segment 2 is disposed on the carrier truck 1 and is connected to the rotatable turret 3 by means of an articulated joint. The boom arm segment 2 has a free end configured so that it can be engaged and locked to the remainder of the boom arms shown arranged on auxiliary truck 4. The remaining boom arms are releasably mounted on the carrier table 5 on the auxiliary truck 4 such that the boom arm segment 6 having a free end is disposed on top of the stack. This upper boom arm segment 6 defines an inner channel for accommodating an extension piece 7 which is telescopically mounted inside the channel of the arm segment 6. The extension piece can be driven into the arm segment 2 via an actuator 13. When the extension piece 7 is driven into the second arm segment 2, the first arm segment 6 and the second arm segment 2 are interengaged in a form-fitting manner and are then rigidly interconnected. The concrete placing boom can be driven into its work position after the remaining boom arms are released from the carrier table 5 and all hydraulic lines are connected including the concrete pumping line.

The carrier table 5 is rotatably mounted on the second truck 4 to facilitate engagement of the extension piece 7 with the arm segment 2 in a horizontal plane. As a rule, the terrain on which the first and second vehicles travel at the work site are not completely planar, that is, the extension piece 7 and the arm segment 2 are at different elevations for the coupling operation. For this reason, the carrier table 5 is equipped so that it can be hydraulically moved in elevation.

According to another embodiment of the invention, it is not necessary to provide a hydraulic unit to move the carrier table 5 itself relative to the vehicle 4 if other means are provided. Thus, the truck 4 can be equipped with telescopically adjustable hydraulic outriggers 14 to lift the truck per se including the carrier table 5 in elevation as required.

Figure 2:
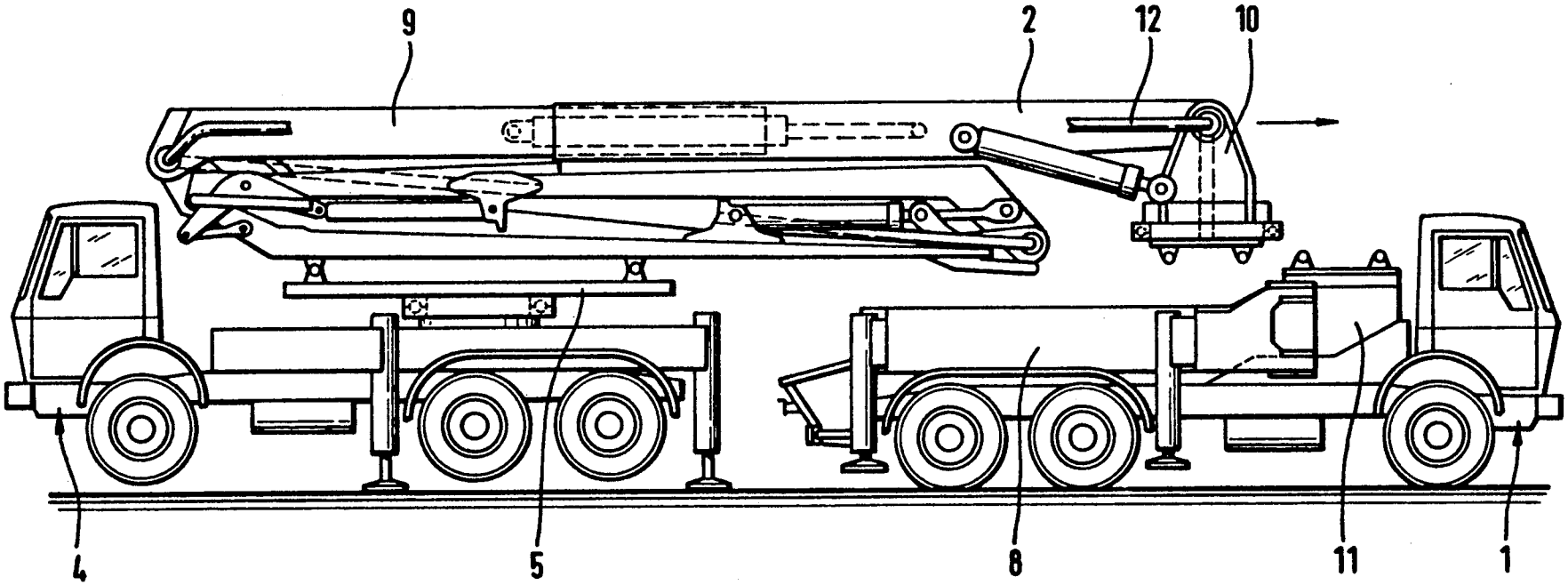

Another embodiment of the invention is shown in FIG. 2 wherein a disconnect location is arranged in the concrete placing boom assembly between the base frame 8 and the turret 10. The two trucks are driven to the assembly location whereat the concrete placing boom is assembled. The telescopically mounted arm segment 9 with the turret 10 is moved outwardly to the mounting location on the base frame 8 of the first vehicle 1. After the boom components are connected and locked including the concrete pumping pipe, then the boom stack is removed from the second vehicle 4.

It is understood that the foregoing description is that of the preferred embodiments of the invention and that various changes and modifications may be made thereto without departing from the spirit and scope of the invention as defined in the appended claims.

What is claimed is:

1. A concrete placing boom assembly for ready-mix concrete for use with two trucks, the concrete placing boom assembly comprising:

a base frame disposed on a first one of the trucks;

a rotatable turret rotatably mountable on said base frame;

a carrier table rotatably mounted on the second one of said trucks;

a foldable boom pivotally connected to said turret and including a plurality of boom arms articulately connected one with the other so as to be unfoldable to define an extended boom and foldable to define a stack supported on said carrier table;

one of said boom arms being a base boom arm including a first elongated segment pivotally connected to a next one of said boom arms and said first elongated segment lying atop said stack when said foldable boom is at rest on said carrier table;

said base boom arm further including a second elongated segment pivotally connected directly to said turret; and, telescopic means for telescopically engaging said first and second elongated segments so as to permit said base boom arm to be shortened and lengthened independently of the remainder of said boom arms; and, interface separation means for dividing said concrete boom assembly into a first section transportable on said carrier table and a second section transportable on said first truck.

2. The concrete placing boom assembly of claim 1, hydraulic means disposed on said second truck for displacing said carrier table in elevation with respect to said first truck.

3. The concrete placing boom assembly of claim 1, said interface separation means being disposed in said base boom arm for separating said first elongated segment completely from said second elongated segment thereby causing said first section to include said first elongated segment and the remaining ones of said boom arms and said second section to include said second elongated segment, said turret and said base frame.

4. The concrete placing boom assembly of claim 1, said interface separation means being disposed between said base frame and rotatable turret for separating said turret completely from said base frame thereby causing said first section to include said foldable boom and said turret and said second section to include said base frame.

* * * * *